US006679277B2

(12) United States Patent
Choi

(10) Patent No.: US 6,679,277 B2
(45) Date of Patent: Jan. 20, 2004

(54) APPARATUS FOR OPENING/CLOSING A VENTILATION WINDOW OF A TENT

(76) Inventor: Kyong Jai Choi, 312-301 Beach Apt., 29/5, 148, Namcheon-Dong, Suyoung-ku, Pusan (KR), 613-101

( * ) Notice: Subject to any disclaimer, the term of this patent is extended or adjusted under 35 U.S.C. 154(b) by 0 days.

(21) Appl. No.: 10/095,444

(22) Filed: Mar. 13, 2002

(65) Prior Publication Data

US 2003/0136437 A1 Jul. 24, 2003

(30) Foreign Application Priority Data

Jan. 23, 2002 (KR) ..... 2002-2149

(51) Int. Cl.[7] ..... E04H 15/14

(52) U.S. Cl. ..... 135/93; 135/117; 135/100; 24/381; 24/429

(58) Field of Search ..... 135/91, 93, 100, 135/117, 120.4, 901, 143; 24/429, 381; 160/368

(56) References Cited

U.S. PATENT DOCUMENTS 4,221,256 A * 9/1980 Karaki ..... 160/368
5,595,559 A * 1/1997 Viel ..... 482/91
5,915,400 A * 6/1999 Pohl et al. ..... 135/125
6,334,455 B1 1/2002 Nunez, Sr.
6,338,356 B1 1/2002 Wallenstatter
2002/0000241 A1 1/2002 Lee

FOREIGN PATENT DOCUMENTS

WO 01/96694 12/2001 ..... E04H/15/42

* cited by examiner

*Primary Examiner*—Carl D. Friedman
*Assistant Examiner*—Nahid Amiri
(74) *Attorney, Agent, or Firm*—Jacobson Holman PLLC

(57) ABSTRACT

Disclosed is an apparatus for opening/closing a ventilation window of a tent. The apparatus has a fastener for opening/closing the ventilation window for ventilating an inner space of the tent by assembling/disassembling combining members with each other, a hole formed on a body of the fastener, an opening rope of which one end is tied up to the hole, and a closing rope of which one end is tied up to a connection hole formed on a knob combined to a long hole formed on the body of the fastener. The ventilation window is opened as the opening rope is pulled, and closed as the closing rope is pulled. Thus, there is no inconvenience in opening/closing the ventilation window as the user can open/close the ventilation window while he/she sits down on the floor of the tent.

3 Claims, 3 Drawing Sheets

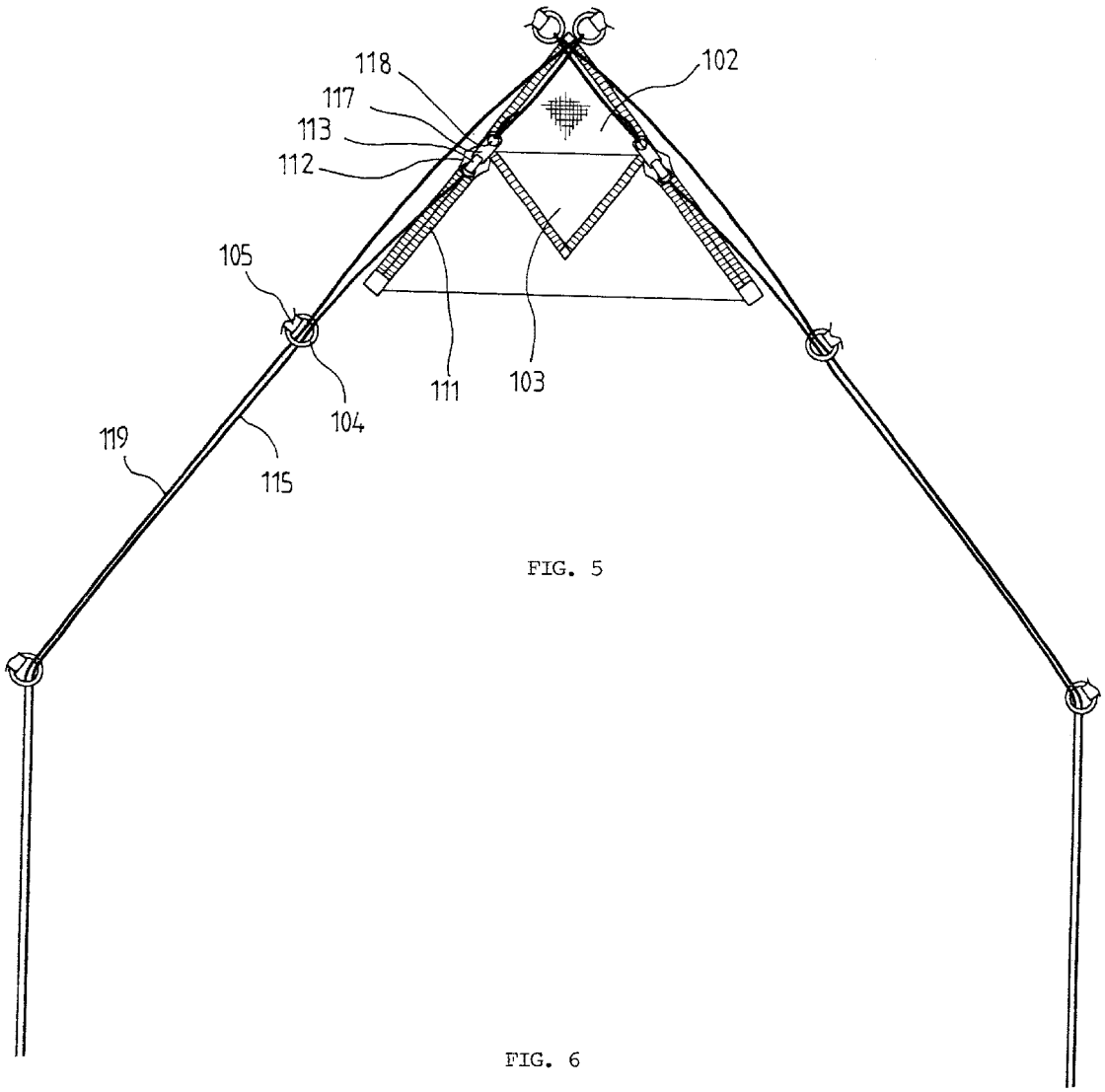
FIG. 5
FIG. 6
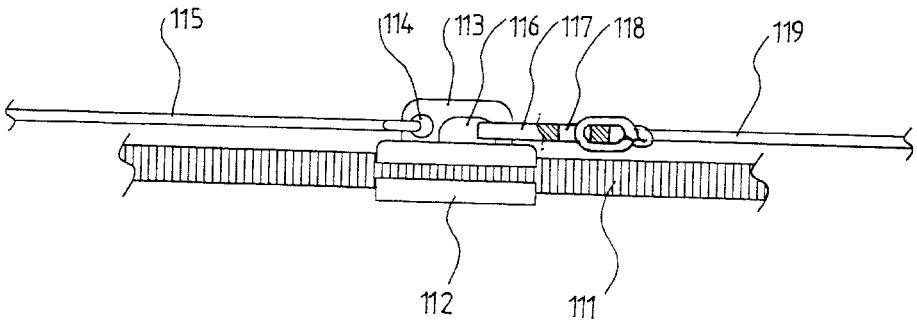

APPARATUS FOR OPENING/CLOSING A VENTILATION WINDOW OF A TENT

BACKGROUND OF THE INVENTION

1. Field of the Invention

The present invention relates to a tent having a ventilation window, and more particularly, to an apparatus for opening/closing a ventilation window of a tent in which the ventilation window can be opened/closed conveniently by simply pulling up an opening rope and a closing rope.

2. Description of the Prior Art

Generally, a tent used for camping has one or more ventilation window for providing a user with convenience of preventing discomfort and oppressive atmosphere in the tent.

The ventilation window is closed by assembling a plurality of combining members respectively lined on the edge of the ventilation window and the edge of a window door. The combining members are assembled/disassembled with each other so as to open/close the ventilation window by a fastener which is moved bilaterally by a user.

However, the ventilation window is generally formed on an uppermost area of the tent, so it is hard for the user to open and close the ventilation window especially for the case of a tent used for camping or gathering in the field.

In other words, in order to open or close the ventilation window, the user has to put a product such as a box or a chair and go up the product, and then he/she has to move the fastener manually.

Thus, the user feels inconvenience every time when he/she wants to open or close the ventilation window.

SUMMARY OF THE INVENTION

The present invention has been made to overcome the above-mentioned problem of the prior art, and accordingly, it is the object of the present invention to provide an apparatus for opening/closing a ventilation window of a tent, which can provide a user with convenience to open/close the ventilation window while the user sits down in the tent.

The above object of the present invention is accomplished by an apparatus for opening/closing a ventilation window, comprising: a fastener for opening/closing a ventilation window for ventilating an inner space of a tent by assembling/disassembling combining members with each other, the combining members being lined on an edge of the ventilation window and an edge of a window door, the fastener being formed with a hole on a body thereof; an opening rope of which one end is tied up on the hole, the opening rope being configured to open the ventilation window; and a closing rope of which one end is tied up on a connection hole formed on a knob combined to a long hole formed on the body of the fastener, the closing rope being configured to close the ventilation window.

According to the present invention, the ventilation window can be opened/closed easily by simply pulling down the opening ropes and the closing ropes. So, there is no inconvenience in opening/closing the ventilation window as the user can open/close the ventilation window while he/she sits down on the floor of the tent.

BRIEF DESCRIPTION OF THE DRAWINGS

The above-mentioned objects and the feature of the present invention will be more apparent by describing the preferred embodiment of the present invention by referring to the appended drawings, in which:

FIG. 5 is an enlarged view of the opening/closing apparatus according to the present invention; and FIG. 6 is a view showing the state that an opening rope and a closing rope are connected with a fastener of the ventilation window.

DESCRIPTION OF THE PREFERRED EMBODIMENT

Figure 1:
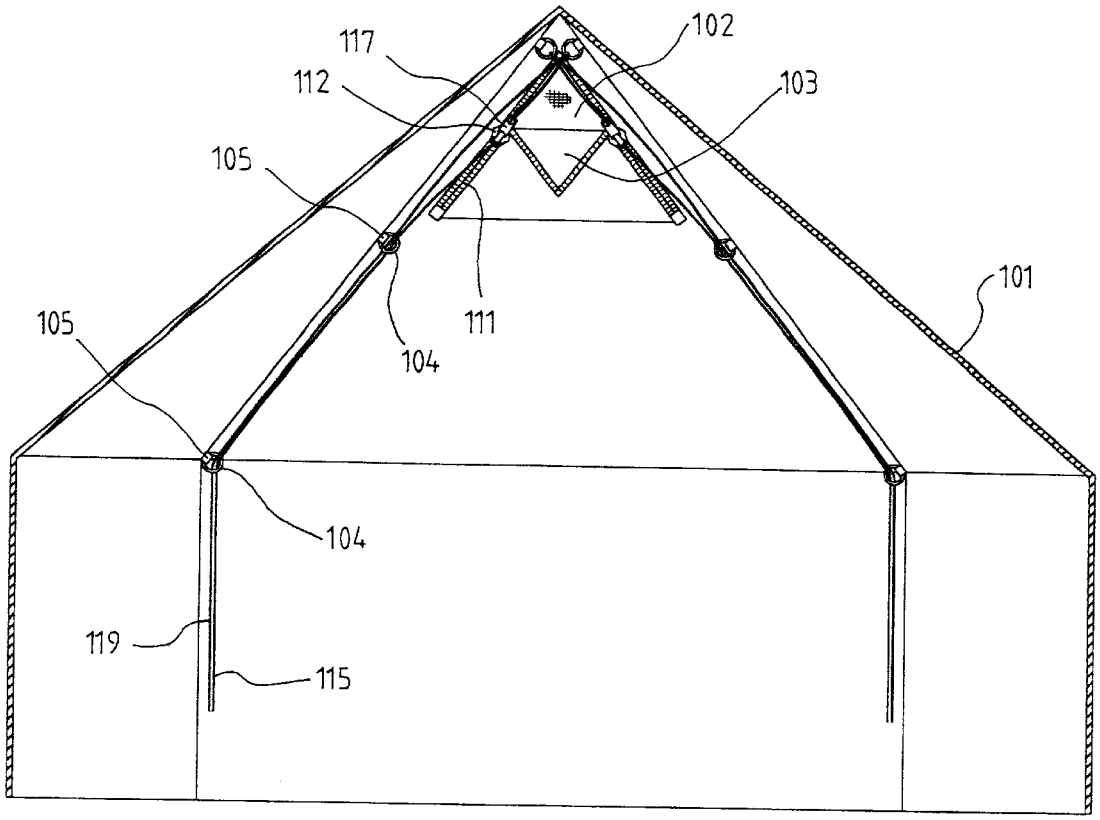
FIG. 1 is a view showing the construction of the ventilation window opening/closing apparatus according to the present invention.

Hereinbelow, the present invention will be described in greater detail with reference to the accompanying drawings.

The apparatus for opening/closing a ventilation window according to the present invention has fasteners 112 for opening/closing ventilation windows 102 for ventilating the inner space of a tent 101 by assembling/disassembling combining members 111 with each other. The combining members 111 are lined on the edge of each ventilation window 102 and also the edge of each window door 103 of the tent 101.

The apparatus of the present invention also has a hole 114 formed on a body 113 of the fastener 112, an opening rope 115 of which one end is tied up to the hole 114, and a closing rope 119 of which one end is tied up to a connection hole 118 formed on a knob 117 combined to a long hole 116 formed on the body 113 of the fastener 112.

The apparatus of the present invention further has a plurality of connection rings 104 through which the opening ropes 115 and the closing ropes 119 pass so that the opening ropes 115 and the closing ropes 119 are secured. The connection rings 104 are respectively fixed on inner walls of the tent 101 by connection cloths 105 so that the opening ropes 115 and the closing ropes 119 are arranged on the inner corner areas of the tent 101.

Furthermore, the opening rope 115 and the closing rope 119 respectively have colors different from each other so that the opening rope 115 and the closing rope 119 can be distinguished from each other.

The operation of the present invention having the above-described construction is as follows.

In the state that the ventilation windows 102 of the tent 101 are close as shown in FIG. 1, the fasteners 112 are disposed to the state that the combining members 111 lined on the ventilation windows 102 and the window doors 103 are assembled with each other.

In the state that the ventilation windows 102 are closed by the fasteners 112, the user pulls down the opening rope 115 hung down toward the floor of the tent 101.

As the opening rope 115 is pulled down, the body 113 and the hole 114 to which one end of the opening rope 115 is tied up are moved, and at the same time, the fastener 112 with which the body 113 is combined begins to move.

Accordingly, the combining members 111 are dissembled with each other while the fastener 112 is being moved, whereby the window door 103 is opened and thus the ventilation window 102 becomes open.

Figure 4:
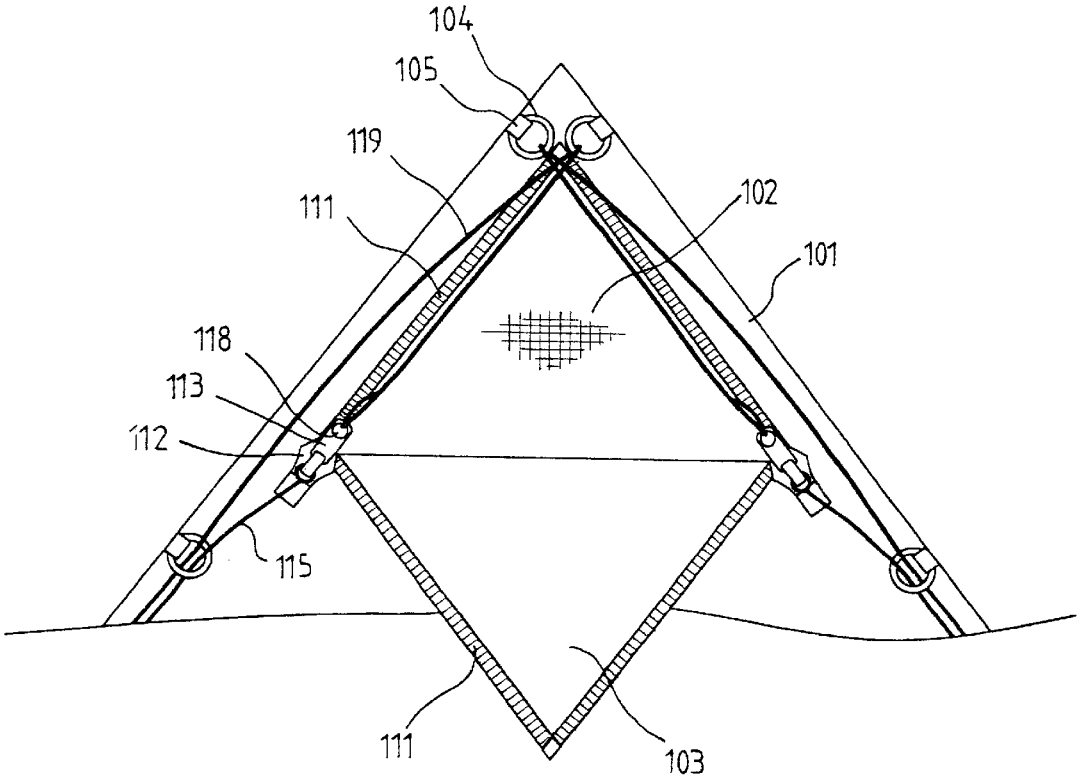
FIG. 4 is an enlarged view of the apparatus according to the present invention when the ventilation window is fully open.

Afterwards, as the user goes on to pull down the opening rope 115, the window door 103 is dropped fully, and at the same time, the ventilation window 102 is opened fully as shown in FIG. 4.

As the ventilation window 102 is open, the air in the tent 101 can be ventilated, and the discomfort and oppressive atmosphere caused by the rise in temperature can be prevented.

Meanwhile, the closing rope 119 is used for closing the open ventilation window 102.

In other words, as the user pulls down the closing rope 119, the connection hole 118 of the knob 117 through which one end of the closing rope 119 is tied up, the body 113, and the fastener 112 are moved together in an opposite direction.

Figure 2:
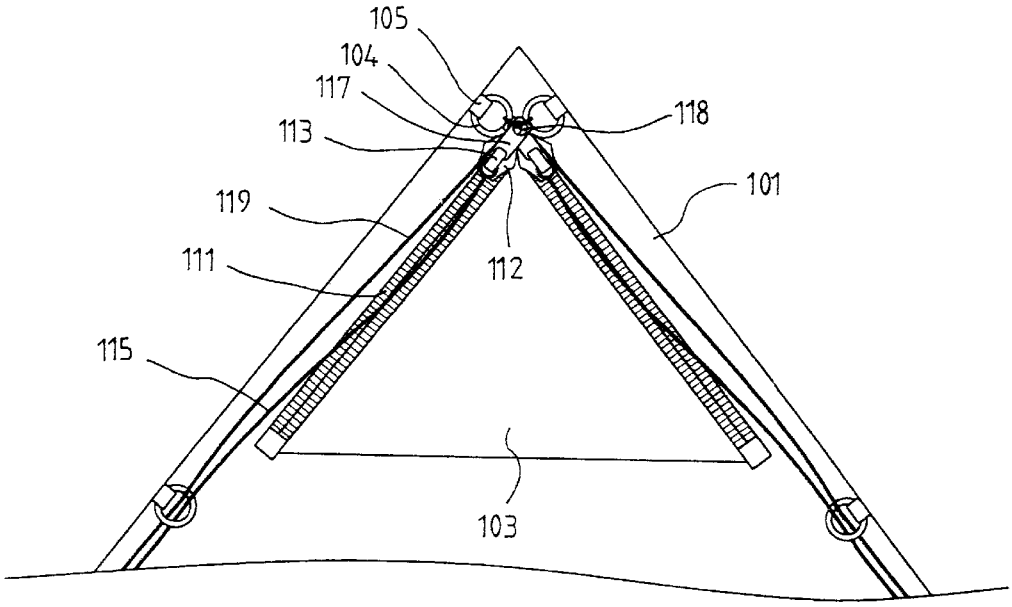
FIG. 2 is an enlarged view of the main part of the apparatus according to the present invention when the ventilation window is close.
Figure 3:
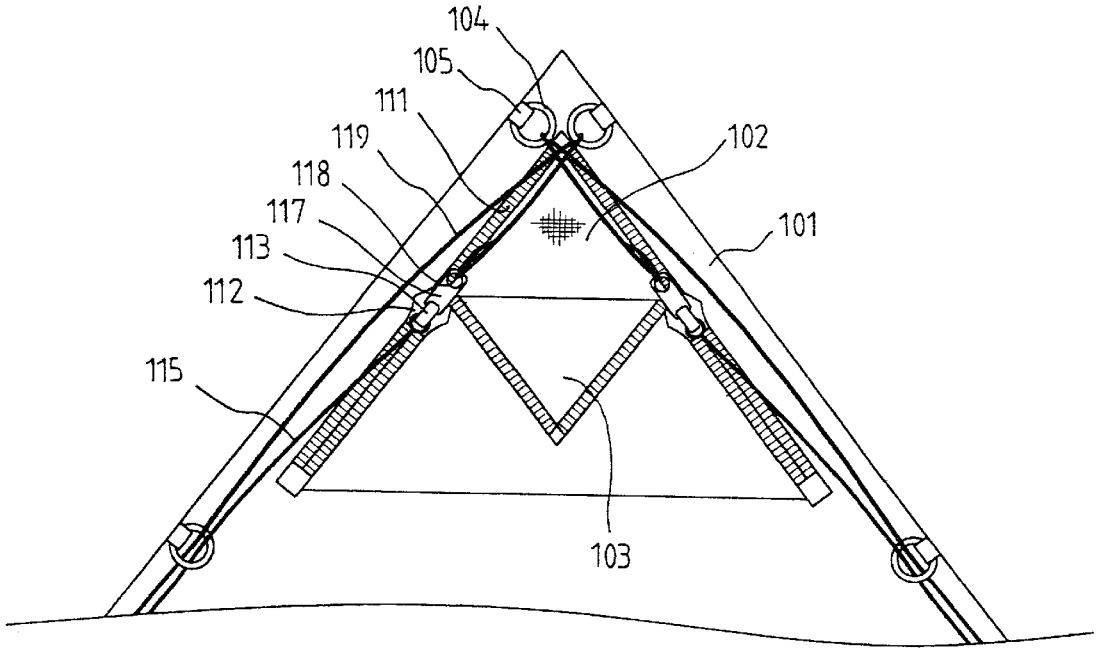
FIG. 3 is an enlarged view of the apparatus according to the present invention when the ventilation window is half open.

As the fastener 112 is moved in the opposite direction, the combining members 111 of the ventilation window 102 and the window door 103, which have been disassembled with each other, are assembled again, and accordingly, the ventilation window 102 is closed by the window door 103 according to the process shown consecutively in FIG. 4, FIG. 3 and FIG. 2.

In order to open or close the ventilation window 102 and the window door 103, both of the opening ropes 115 connected respectively to both of the fasteners 112 can be pulled down simultaneously by two men, or one of the opening ropes 115 can be pulled down by one man to open one side of the ventilation window 102 after which another of the opening ropes 115 is pulled down to open the other side of the ventilation window 102.

In the mean time, the other ends of the opening ropes 115 and the closing ropes 119 are dropped on the floor of the tent 101, which does not offer a good sight and puts the user inconvenience in moving in the tent 101.

To prevent such a problem, in the present invention, a plurality of connection rings 104 are fixed on the corner areas in the tent 101 by connection cloths 105.

In other words, the opening ropes 115 and the closing ropes 119 can be arranged and secured well, by passing the opening ropes 115 and the closing ropes 119 through the connection rings 104 disposed on the appearance lines of the tent 101.

Furthermore, since the opening ropes 115 and the closing ropes 119 can be arranged finely by the connection rings 104, the inner space of the tent 101 provides a fine view and becomes clear.

Meanwhile, the user may feel inconvenient in distinguishing the opening ropes 115 from the closing ropes 119, even when the opening ropes 115 and the closing ropes 119 are arranged well by the connection rings 104.

To get over such an inconvenience, the opening ropes 115 and the closing ropes 119 are made to have colors different from each other, which provides the user with the convenience of rapid discrimination between the opening ropes 115 and the closing ropes 119.

According to the present invention, the ventilation window 102 can be opened/closed easily by simply pulling down the opening ropes 115 and the closing ropes 119. So, there is no inconvenience in opening/closing the ventilation window 102 as the user can open/close the ventilation window 102 while he/she sits down on the floor of the tent 101.

Furthermore, the opening ropes 115 and the closing ropes 119 can be arranged well along the appearance lines of the tent 101, by the connection rings 104 fixed by the connection cloths 105 on the corner areas in the tent 101. Moreover, since the colors of the opening ropes 115 and the closing ropes 119 are different from each other, the opening ropes 115 and the closing ropes 119 can be distinguished easily and rapidly.

Although the preferred embodiment of the present invention has been described, it will be understood by those skilled in the art that the present invention should not be limited to the described preferred embodiment, but various changes and modifications can be made within the spirit and the scope of the present invention. Accordingly, the scope of the present invention is not limited within the described range but the following claims.

What is claimed is:

1. An apparatus opening/closing a ventilation window in a tent, comprising: a tent window door of a ventilation window for ventilating an inner space of the tent, said window door having two openable sides;

first and second fasteners for opening/closing a respective one of said two openable sides of said window door, each of said fasteners being formed as a body with a hole therein;

each of said two openable sides having a pair of cooperating assembling/disassembling combining members for joining to or separating from one another through sliding action of a respective one of said fasteners upward or downward therealong, a first member of each pair of cooperating members forming a first row lined on the tent along an edge of the ventilation window and a second member of each pair of cooperating members forming a second row lined along an edge of a respective openable side of said window door;

a first opening rope having one end tied up on the hole of said first fastener and a second opening rope having one end tied up on the hole of said second fastener, each of said opening ropes being configured to open a respective one of said openable sides of said ventilation window door by sliding a respective one of said fasteners to separate a respective pair of cooperating assembling/disassembling combining members; and a first closing rope having one end tied up on a connection hole formed formed on the body of the first fastener and a second closing rope having one end tied up on a connection hole formed formed on the body of the second fastener, each of said closing ropes being configured to close a respective one of said openable sides of said ventilation window door by sliding a respective one of said fasteners to join a respective pair of cooperating assembling/disassembling combining members.

2. The apparatus as set forth in claim 1, wherein said first opening rope with associated first fastener is operable independently of said second opening rope with associated second fastener to open only one of said openable sides of said window door at a time.

3. The apparatus as set forth in claim 1, wherein said first closing rope with associated first fastener is operable independently of said second closing rope with associated second fastener to close only one of said openable sides of said window door at a time.

* * * * *